US005873662A

United States Patent [19]

Clevinger

[11] Patent Number: 5,873,662

[45] Date of Patent: Feb. 23, 1999

[54] PRINTER WITH DANCER ARM AND REEL BRAKE AND METHOD THEREFOR

[75] Inventor: Anthony Lydale Clevinger, Glen Ellyn, Ill.

[73] Assignee: Illinois Tool Works Inc., Glenview, Ill.

[21] Appl. No.: 984,445

[22] Filed: Dec. 3, 1997

[51] Int. Cl.[6] ..... B41J 33/14

[52] U.S. Cl. ..... 400/234; 400/208; 242/343.2

[58] Field of Search ..... 400/234, 613, 400/618, 208; 101/DIG. 31; 242/343, 343.1, 343.2, 418.1, 419.1, 421, 421.5

[56] References Cited

U.S. PATENT DOCUMENTS

| | | | |
|---|---|---|---|
| 4,310,131 | 1/1982 | Althuber et al. | 242/418.1 |
| 4,350,454 | 9/1982 | Schoenlein | 400/234 |
| 4,369,935 | 1/1983 | Yamanaka | 242/343 |
| 4,710,044 | 12/1987 | Ackermann | 400/234 |
| 5,433,539 | 7/1995 | German | 400/234 |

FOREIGN PATENT DOCUMENTS

| | | | |
|---|---|---|---|
| 0 389 148 | 9/1990 | European Pat. Off. | 400/234 |
| 0683055 | 11/1995 | European Pat. Off. . | |
| 2 150 502 | 7/1985 | United Kingdom | 400/234 |

OTHER PUBLICATIONS

IBM Technical Disclosure Bulletin. vol. 31, No. 5, Oct. 1988.

IBM Technical Disclosure Bulleting. vol. 24, No. 11B, Apr. 1982.

*Primary Examiner*—Christopher A. Bennett

[57] ABSTRACT

A printer system for transferring print from a ribbon onto a substrate. The system including an unwind reel rotatable to supply tensioned ribbon from a ribbon supply roll disposed thereon, and a pivotal dancer arm biased in a first direction. The ribbon is supplied from the unwind reel to a dancer guide roller of the dancer arm, which is pivotal against the bias of a spring member by drawing tension on the ribbon. A pivotal brake member having a brake portion is biased into engagement with the unwind reel to brake rotation thereof, thereby stemming the supply of ribbon, and a brake engagement member on the dancer arm is engageable with the brake member to pivot the brake member away from the unwind reel to supply ribbon therefrom.

17 Claims, 2 Drawing Sheets

PRINTER WITH DANCER ARM AND REEL BRAKE AND METHOD THEREFOR

CROSS REFERENCE TO RELATED APPLICATIONS

The present application is related to copending U.S. application Ser. No. 08/008,342 filed Jan. 16, 1998 entitled "Bi-Directional Thermal Printer and Method Therefor", and copending U.S. application Ser. No. 08/984,461, filed Dec. 3, 1997 entitled "Printer with Sealable Housing and Adjustable Back-up Plate and Method Therefor", both assigned commonly herewith, and incorporated by reference herein.

BACKGROUND OF THE INVENTION

The invention relates generally to product coding and marking operations, and more particularly to systems and methods for controlling ribbon tension in printer systems useable for transferring print from a ribbon onto a substrate.

In many printing systems an inked ribbon or foil is supplied from an unwind reel, between a print head and a substrate and then to a rewind reel. The ribbon is usually drawn under tension from the unwind reel by the rewind reel or by a ribbon feed roller. The ribbon is often advanced intermittently during or between printing operations, wherein the print head is actuatable, either rotationally or relatively linearly, to transfer ink from the ribbon onto a target area of the substrate. These types of printing systems include, for example, thermal printers and hot stamp imprinters useable for printing variable information on products and packaging in coding and marking operations.

In printing systems where the ribbon is drawn from an unwind reel, it is known generally to control tension on the ribbon with a pivotal dancer arm having a dancer ribbon guide about which the ribbon is disposed. As ribbon is drawn from the unwind reel, the dancer arm pivots to maintain relatively constant tension thereon, and more particularly the dancer arm compensates for the inability of the unwind reel to change its angular velocity relatively instantaneously in response to changing demand for ribbon, resulting from the relatively large moment of inertia of the unwind reel.

In some applications the dancer arm does not compensate fully for the relatively large moment of inertia of the unwind reel, particularly in applications where the ribbon is accelerated and decelerated relatively rapidly. More particularly, tension in the ribbon may become excessive during ribbon acceleration, resulting possibly in breakage thereof. Additionally, the ribbon may become excessively slack during ribbon deceleration, which is also undesirable. These adverse effects are especially problematic in intermittent ribbon drawing applications where the ribbon is advanced and stopped relatively frequently, referred to herein as rapid cycling, which is typical in high production coding and marking operations.

It is also known generally to indicate when ribbon supplied from the unwind reel has become depleted. Europoean Patent Publication No. EP 0,683,055 entitled "Economic Use of Impression Transfer Material Printing Method" published Nov. 22, 1995 in the name of Prestek Limited, for example, discloses an electronic sensor located along the ribbon supply path for signalling lack of ribbon and for disabling the printing apparatus in response thereto.

The present invention is drawn toward advancements in the art of controlling ribbon tension and braking rotation of a ribbon unwind reel in printer systems useable for transferring print from a ribbon onto a substrate, particularly in coding and marking operations.

It is thus an object of the invention to provide novel methods and systems for controlling ribbon tension that overcomes problems in the prior art.

It is a more particular object of the invention to provide novel methods and systems for controlling ribbon tension in printer system useable for transferring print from a ribbon supplied from a ribbon supply roll disposed on a rotatable unwind reel with a pivotal dancer arm. And it is a related object of the invention to bias a pivotal brake member toward and into engagement with the unwind reel to brake rotation of the unwind reel to stem the supply of ribbon therefrom when drawing tension on the ribbon decreases to a first tension, whereby the dancer arm is engageable with the brake member to pivot the brake member away from the unwind reel to supply ribbon therefrom when the drawing tension increases.

It is another object of the invention to provide novel methods and systems for controlling ribbon tension in printer systems and indicating ribbon breakage or ribbon depletion by actuating a sensor with the dancer arm when the ribbon tension is reduced to a second tension less than the first tension.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
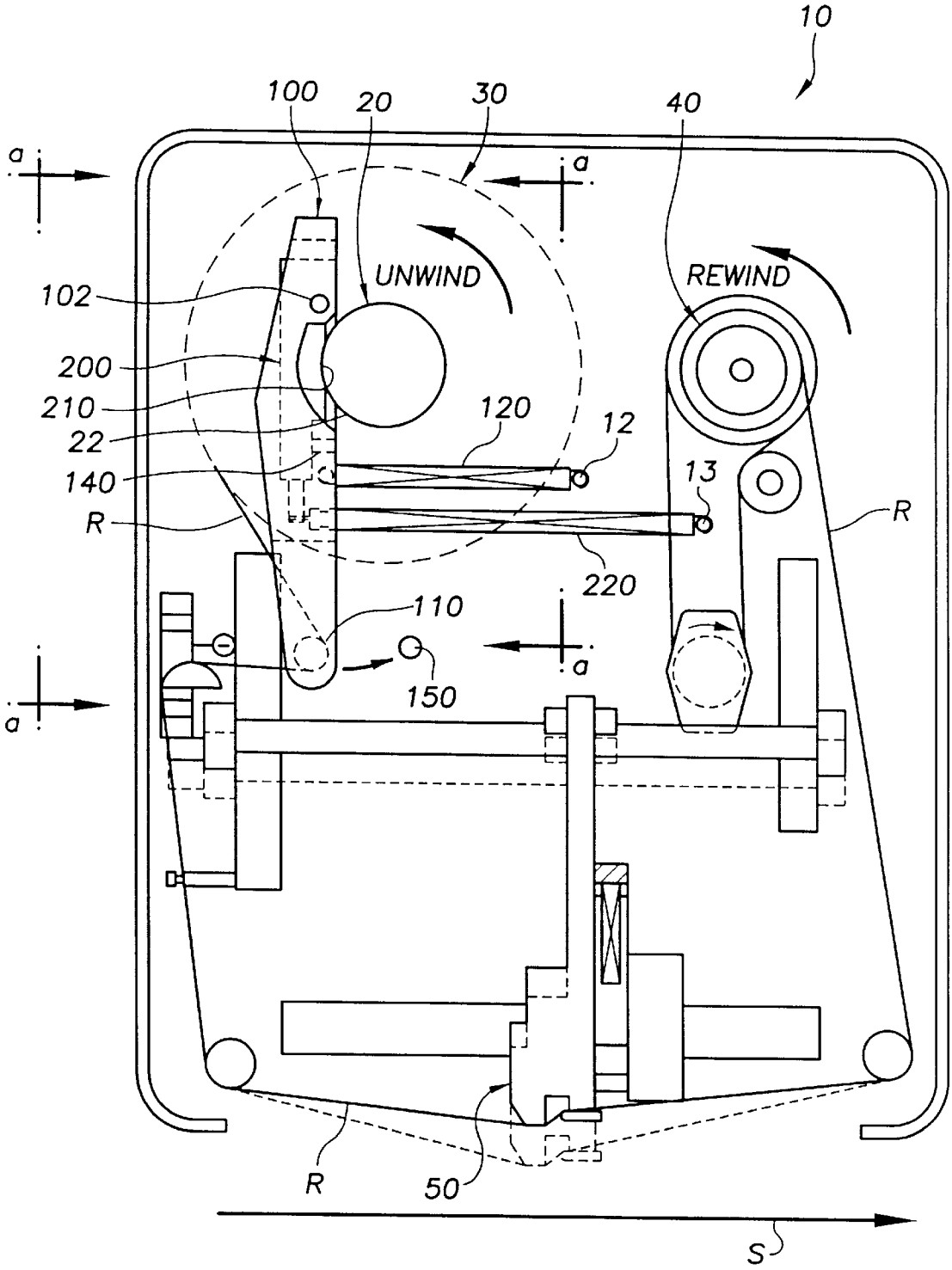
FIG. 1 is a partial front elevational view of a printer having a dancer arm with a reel brake according to an exemplary embodiment of the invention.

FIG. 1. is an exemplary printer system 10 incorporating aspects of the present invention, and is particularly suitable for product and package coding and marking operations. The printer system 10 includes generally an unwind reel 20, illustrated best in FIG. 2, rotatable to supply tensioned ribbon R from a ribbon supply roll 30, shown in phantom, disposed thereon. The ribbon R is drawn under tension from the unwind reel 20 by a motor driven rewind reel 40, but may be drawn alternatively by a ribbon feed roll or by other means. The ribbon R is supplied from the unwind reel 20 to a print position between a print head 50 and a substrate S, where ink is transferred therefrom onto a target area of the substrate S. After printing, the ribbon R is supplied to the rewind reel 40 or alternatively to some other location.

Figure 2:
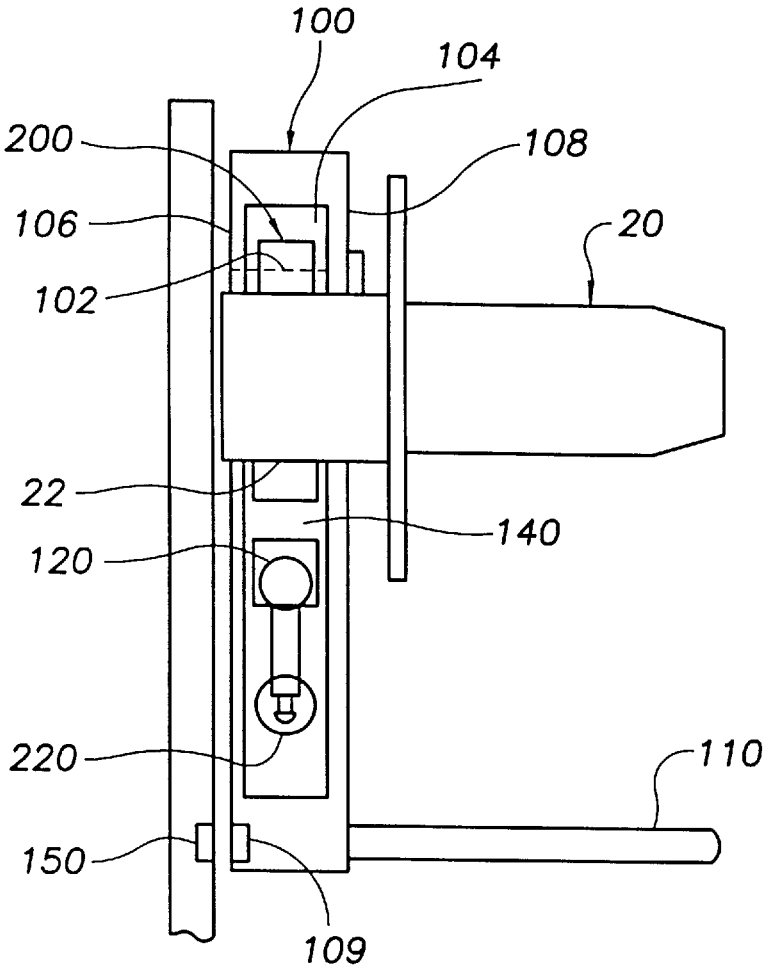
FIG. 2 is a partial end elevational view along lines a—a of the dancer arm and reel brake of FIG. 1.

FIGS. 1 and 2 illustrate a pivotal dancer arm 100 having a first end portion with a dancer guide roller 110. A first spring member 120 coupled between the dancer arm 100 and a frame portion 12 of the printer system 10 biases the dancer arm 100 in a first direction toward the unwind reel 20. As drawing tension on the ribbon R increases, the ribbon R, which is disposed about the dancer guide roller 110, pivots the dancer arm 100 in a second direction against the bias of the first spring member 120 to supply ribbon while the unwind reel 20 and the ribbon supply roll 30 disposed thereon accelerate up to speed. As the drawing tension on the ribbon decreases, the dancer arm 100 pivots in the first direction with the bias of the spring member 120 to prevent formation of slack in the ribbon R while the unwind reel 20 and the ribbon supply roll 30 disposed thereon decelerate. The dancer arm 100 thus controls generally tension on the ribbon R supplied from the unwind reel 20, and is particularly effective when the size and hence moment of inertia of the ribbon supply roll 30 is great, as it is before a substantial amount of ribbon is supplied from the ribbon supply roll 30.

FIGS. 1 and 2 also illustrate a pivotal brake member 200 having a brake portion 210 engageable with the unwind reel 20, and more particularly with a brake drum outer portion 22 thereof. In one preferred embodiment, the brake portion 210 is a curved surface of the brake member 200, and the brake drum 22 has a resilient rubber surface to increase friction with the brake portion 210 of the brake member 200. A second spring member 220 coupled between the brake member 200 and the frame portion 13 of the printer system 10 biases the brake member 200 in a first direction toward the brake drum, and more particularly biases the brake portion 210 thereof into engagement with the brake drum 22 of unwind reel 20 to brake rotation thereof.

A brake engagement member 140 on the dancer arm 100 is engageable with the brake member 200 to pivot the brake member 200 in a second direction against the bias of the second spring member 220 to disengage the brake member 200 from the unwind reel 20. As the dancer arm 100 pivots in the second direction, in response to increased drawing tension on the ribbon R, the engagement member 140 thereof engages and pivots the brake member 200 in the second direction to disengage the brake portion 210 thereof from the unwind reel 20, thereby permitting rotation of the unwind reel 20 and supply of the ribbon R therefrom. And as the dancer arm 100 pivots in the first direction, in response to decreasing drawing tension on the ribbon R, the brake member 200 also pivots in the first direction toward and into engagement with the unwind reel 20 thereby braking rotation thereof to reduce and ultimately stop the supply of ribbon R therefrom.

In the exemplary embodiment of FIGS. 1 and 2, the dancer arm 100 and the brake member 200 are pivotal independently about a common pivot member 102, wherein the brake member 200 is nested in a recess 104 formed between opposing sides 106 and 108 of the dancer arm 100. According to this configuration, the brake engagement member 140 is disposed between the opposing sides 106 and 108 of the dancer arm 100 where it is engageable with the brake member 200 to pivot the brake member 200 away from the unwind reel 20 when the dancer arm 100 is pivoted away from the unwind reel 20 by drawing tension on the ribbon R. Similarly, the brake member 200 is engageable with the brake engagement member 140 of the dancer arm 100 to pivot the dancer arm 100 toward the unwind reel 20 when the brake member 200 is pivoted toward the unwind reel 20.

In operation, as the drawing tension on the ribbon R increases above a first tension sufficient to overcome combined first and second spring forces of the first and second spring members 120 and 220, the dancer arm 100 and the brake 200 are pivotal away from the unwind reel 20 as discussed above, thereby disengaging the brake from the unwind reel 20 and permitting the supply of ribbon R therefrom. And as the drawing tension on the ribbon is reduced to the first tension, the brake member 200 moves pivotally toward the unwind reel 20 and into engagement therewith, thereby braking rotation thereof. Also, as the brake member 200 moves toward the unwind reel 20, it engages the brake engagement member 140 of the dancer arm 140 and pivots the dancer arm 100 in the first direction toward the unwind reel 20, thereby reducing any slack in the ribbon R.

In one embodiment, the first spring member 120 has a first spring force less than a second spring force of the second spring member 220. As the drawing tension on the ribbon is reduced to a second tension less than the first tension, the first spring member 120 pivots the dancer arm 100 in the first direction past the brake member 200, which at some point ultimately fully engages the unwind reel 20 and stops pivoting as discussed further below. Thus as the brake member 200 fully engages the unwind reel 20 and stops rotation thereof, the dancer arm 100 remains free to continue pivoting in the first direction toward the unwind reel 20 thereby preventing or at least lessening slack formation in the ribbon R.

If the ribbon breaks or the supply thereof becomes depleted, the dancer arm 100 continues to pivot past the brake member 200 and toward the unwind reel 20 until the dancer arm 100 engages the unwind reel 20, and more particularly engages the brake drum portion 22 thereof, which prevents further pivoting of the dancer arm 100. In one embodiment, the dancer arm 100 actuates a sensor 150 disposed along a path of the dancer arm 100 when the dancer arm pivots in the first direction past the brake member 200. Detection of the dancer arm 100 by the sensor 150 generates a signal indicative of the depleted or broken ribbon.

In the exemplary embodiment, the dancer arm 100 is aligned with and actuates the sensor 150 when further pivoting of the dancer arm 100 is prevented or stopped by the unwind reel 20. FIG. 2 illustrates the dancer arm 100 having a magnet 109 located on the first end portion thereof facing the sensor 150, which is preferably a Hall effect sensor that generates an output signal in the presence of the magnetic field from the magnet 109. Other sensors may be used alternatively, and the sensor 150 may be positioned at a location other than the far end of the path followed by the dancer arm 100 moving in the first direction. The sensor 150 may be coupled to an indicator for signaling a broken or depleted ribbon supply, and under these conditions the sensor may also disable the printer system.

While the foregoing written description of the invention enables one of ordinary skill in the art to make and use what is at present considered to be the best mode of the invention, it will be appreciated and understood by those of ordinary skill the existence of variations, combinations, modifications and equivalents within the spirit and scope of the specific exemplary embodiments disclosed herein. The present invention is therefore to be limited not by the specific exemplary embodiments disclosed herein but by all embodiments within the scope of the appended claims.

What is claimed is:

1. A printer system for transferring print from a ribbon onto a substrate, the printer system comprising:

an unwind reel rotatable to supply tensioned ribbon from a ribbon supply roll disposed on the unwind reel;

a pivotal dancer arm having a first end portion with a dancer guide roller, the dancer arm having a first spring member biasing the dancer arm in a first direction, the ribbon supplied from the unwind reel to the dancer guide roller, the dancer arm pivotal in a second direction against the bias of the first spring member by the tensioned ribbon, a pivotal brake member having a brake portion engageable with the unwind reel, the brake member having a second spring member biasing the brake member in a first direction toward the unwind reel to brake rotation of the unwind reel; and a brake engagement member on the dancer arm engageable with the brake member to pivot the brake member in a second direction away from the unwind reel to permit rotation of the unwind reel.

2. The printer system of claim 1, the first spring member coupled between the dancer arm and a frame of the printer system, and the second spring member coupled between brake member and the frame of the printer system, the dancer arm and the brake member pivoted away from the unwind reel when ribbon tension is increased greater than a first ribbon tension to supply ribbon from the unwind reel, and the dancer arm and brake member pivoted toward the unwind reel when ribbon tension is decreased to the first ribbon tension to brake rotation of the unwind reel.

3. The printer system of claim 1, the first spring member having a first spring force less than a second spring force of the second spring member.

4. The printer system of claim 1 further comprising a sensor positioned along a path of the dancer arm when the dancer arm is pivoted in the first direction beyond the brake member, whereby the sensor detects the presence of the dancer arm when the dancer arm is positioned adjacent thereto.

5. The printer system of claim 1, the unwind reel having a resilient brake drum, the brake portion of the brake member engageable with the resilient brake drum to brake rotation of the unwind reel.

6. The printer system of claim 1 further comprising a common pivot member, the dancer arm and the brake member pivotal about the common pivot member, the brake member at least partially pivotally disposeable in a recess of the dancer arm.

7. A method for controlling ribbon tension in a printer system for transferring print form a ribbon onto a substrate, the method comprising:

supplying tensioned ribbon from a ribbon supply roll disposed on a rotatable unwind reel;

supplying ribbon from the unwind reel to a dancer guide roller on a first end portion of a pivot dancer arm biased in a first direction;

pivoting the dancer arm in a second direction against the bias of the dancer arm with tensioned ribbon;

biasing a pivotal brake member in a first direction into engagement with an outer portion of the unwind reel to brake rotation of the unwind reel; and engaging the brake member with the dancer arm to pivot the brake member in a second direction against the bias of the brake member to supply ribbon form the unwind reel.

8. The method of claim 7 further comprising pivoting the dancer arm in the first direction toward the unwind reel and beyond the brake member upon one of ribbon breakage and ribbon depletion, and actuating a sensor when the dancer arm is pivoted beyond the brake member.

9. The method of claim 7 further comprising;

biasing the brake member into engagement with the unwind reel to brake rotation of the unwind reel when ribbon tension is reduced to a first tension;

engaging the dancer arm with the brake member to pivot the dancer arm toward the unwind reel when the brake member is biased toward the unwind reel; and biasing the dancer arm toward the unwind reel and beyond the brake member when ribbon tension is reduced to a second tension less than the first tension.

10. The method of claim 7 further comprising pivoting the dancer arm and the brake member about a common pivot member, and engaging the brake portion with a resilient brake drum of the unwind reel to brake rotation thereof.

11. A printer system comprising:

a rotatable unwind reel;

a pivotal dancer arm biased in a first direction, the dancer arm pivotal in a second direction against the bias;

a pivotal brake member having a brake portion engageable with an outer portion of the unwind reel, the brake member biased in the first direction into engagement with the unwind reel to brake rotation of the unwind reel, the brake member pivotal in a second direction against the bias; and a brake engagement member on the dancer arm engageable with the brake member to pivot the brake member in the second direction when the dancer arm pivots in the second direction, whereby the brake member is disengageable from the unwind reel.

12. The printer system of claim 11 further comprising a first spring member coupled to the dancer arm to bias the dancer arm in the first direction, and a second spring member coupled to the brake member to bias the brake member in the first direction.

13. The printer system of claim 12, the first spring member having a first spring force less than a second spring force of the second spring member.

14. The printer system of claim 11, the dancer arm is pivotal in the first direction relative, to the brake member over a portion of a pivotal range of motion of the dancer arm.

15. The printer system of claim 14 further comprising a sensor positioned along a path of the dancer arm when the dancer arm is pivoted in the first direction relative to the brake member, whereby the dancer arm is detectable by the sensor when the dancer arm is positioned adjacent thereto.

16. The printer system of claim 14 further comprising a common pivot member, the dancer arm and the brake member pivotal about the common pivot member.

17. The printer of claim 16, the dancer arm having opposing sides with a recess therebetween, the brake engagement member disposed between the opposing sides of the dancer arm, the brake member is at least partially pivotally disposable in the recess of the dancer arm.

* * * * *